US011198579B2

(12) United States Patent
Marciano

(10) Patent No.: US 11,198,579 B2
(45) Date of Patent: Dec. 14, 2021

(54) SWITCHING AND EJECTION DEVICE AND METHOD FOR A PLATE-SHAPED ELEMENT

(71) Applicant: BOBST MEX SA, Mex (CH)

(72) Inventor: Pascal Marciano, Bussigny (CH)

(73) Assignee: Bobst Mex SA, Mex (CH)

( * ) Notice: Subject to any disclaimer, the term of this patent is extended or adjusted under 35 U.S.C. 154(b) by 175 days.

(21) Appl. No.: 16/339,331

(22) PCT Filed: Oct. 5, 2017

(86) PCT No.: PCT/EP2017/025300
§ 371 (c)(1),
(2) Date: Apr. 3, 2019

(87) PCT Pub. No.: WO2018/072887
PCT Pub. Date: Apr. 26, 2018

(65) Prior Publication Data
US 2020/0039778 A1 Feb. 6, 2020

(30) Foreign Application Priority Data
Oct. 18, 2016 (EP) ..... 16020405

(51) Int. Cl.
*B65H 29/62* (2006.01)
*B65H 29/60* (2006.01)
(Continued)

(52) U.S. Cl.
CPC ..... *B65H 29/12* (2013.01); *B65H 29/242* (2013.01); *B65H 29/62* (2013.01);
(Continued)

(58) Field of Classification Search
CPC ..... B65H 29/62; B65H 29/60; B65H 29/58; B65H 29/12; B65H 29/242; B65H 5/34;
(Continued)

(56) References Cited

U.S. PATENT DOCUMENTS 2,795,312 A * 6/1957 Howdle ..... B65H 29/60 198/358
5,692,593 A * 12/1997 Ueno ..... B23Q 7/03 198/369.2
(Continued)

FOREIGN PATENT DOCUMENTS

CN 1646404 A 7/2005
EP 2 213 449 A1 8/2010
(Continued)

OTHER PUBLICATIONS

International Search Report issued in related PCT/EP2017/025300 dated Nov. 30, 2017 (4 pages).

*Primary Examiner* — Luis A Gonzalez
(74) *Attorney, Agent, or Firm* — Bookoff McAndrews, PLLC

(57) ABSTRACT

A switching device (130) for transferring and ejecting a plate element (20) in a sorting unit (100), comprises:

transport means (132), capable of transporting (A) the plate element (20) from upstream to downstream;

a pivot (134), positioned in an upstream portion of the transport means (132), and allowing the transport means (132) to tilt relative to a horizontal transverse axis (R2); and raising means (135), secured in a downstream portion of the transport means (132), for tilting the downstream portion of the transport means (132) between a high first position and a low second position, and vice versa, so as to switch the plate element (20), respectively upward and downward.

10 Claims, 6 Drawing Sheets

(51) Int. Cl.
*B65H 29/24* (2006.01)
*B65H 29/12* (2006.01)

(52) U.S. Cl.
CPC ..... *B65H 2403/514* (2013.01); *B65H 2404/2641* (2013.01); *B65H 2701/1764* (2013.01)

(58) Field of Classification Search
CPC .... B65H 2404/2641; B65H 2404/2615; B65H 2404/2693; B65H 2403/514; B65G 47/647
See application file for complete search history.

(56) References Cited

U.S. PATENT DOCUMENTS

| | | | | |
|---|---|---|---|---|
| 8,480,550 | B2 * | 7/2013 | Taketsugu | B65H 29/62 493/29 |
| 9,284,133 | B2 * | 3/2016 | Theriault | B65H 33/12 |
| 9,868,607 | B2 * | 1/2018 | Brizzi | B65H 29/12 |
| 2001/0052449 | A1 | 12/2001 | Emery | |
| 2010/0210436 | A1 | 8/2010 | Taketsugu | |
| 2013/0062263 | A1 * | 3/2013 | Nakano | B07C 5/36 209/552 |
| 2014/0291113 | A1 | 10/2014 | Theriault et al. | |
| 2016/0250080 | A1 * | 9/2016 | Wada | B65H 29/585 198/364 |
| 2016/0280494 | A1 | 9/2016 | Brizzi | |
| 2016/0297638 | A1 * | 10/2016 | Eichelberg | B65H 29/58 |

FOREIGN PATENT DOCUMENTS

| | | | | |
|---|---|---|---|---|
| JP | H01132645 | U | | 9/1989 |
| JP | 05147801 | A | * | 6/1993 |
| JP | 06059594 | A | * | 3/1994 |
| JP | H08169536 | A | | 7/1996 |
| JP | 2003237974 | A | | 8/2003 |
| JP | 2005085013 | A | | 3/2005 |
| JP | 2005521612 | A | | 7/2005 |
| JP | 2009078462 | A | | 4/2009 |
| JP | 2016514657 | A | | 5/2016 |
| KR | 20100021655 | A | | 2/2010 |
| WO | 2013/063701 | A1 | | 5/2013 |
| WO | 2014/146757 | A1 | | 9/2014 |

* cited by examiner

SWITCHING AND EJECTION DEVICE AND METHOD FOR A PLATE-SHAPED ELEMENT

CROSS-REFERENCE TO RELATED APPLICATION(S)

This application is a National Stage under 35 U.S.C. § 371 of International Application No. PCT/EP2017/025300, filed on Oct. 5, 2017, which claims priority to European Patent Application No. 16020405.3, filed Oct. 18, 2016, the contents of all of which are incorporated by reference in their entirety.

The present invention relates to a device which performs the switching of one or more plate elements taken to be separated and ejected from the normal processing circuit, while the plate elements travel continuously at the output of a processing machine. The ejected plate elements are used for example for inspection, and/or for their scrapping. The invention relates also to a switching and ejection method for a plate element.

Plate element processing machines are used in the field of packaging manufacturing, and in particular packages manufactured from sheets or strips, in particular elements in the form of sheets of paper, of plastic or of cardboard, whether flat or corrugated. They can be machines which perform a processing of these plate elements, namely, for cutting, scoring, embossing and printing. They can also be machines performing such processing and also, subsequently, the operations of folding and gluing to form, in line, a folding box.

STATE OF THE ART

In the machines of the prior art this ejection is performed by stopping the machine to manually take the plate element to be rejected. In other cases, a systematic inspection is performed continuously on each individual cut when the latter passes through a module dedicated to inspection, for example to visual inspection.

It is a matter of switching and ejecting, by separating from the normal processing circuit, on demand or cyclically, at least one plate element forming a reject. Such a switching from the normal processing circuit is particularly implemented downstream of a printing machine, in the case of printing performed on the top face of the plate element, without contact with the top face of the plate element in order not to damage this top face. Such switching from the normal processing circuit can also be implemented at another point on the normal processing circuit, to set aside the non-conforming plate elements.

SUMMARY OF THE INVENTION

One aim of the present invention is to propose a switching device and a switching and ejection method, for transferring a plate element from an upstream module to a first downstream module or a second downstream module situated under the first downstream module.

Another aim of the invention is to provide a switching device and a switching and ejection method that make it possible to continuously advance plate elements, without slowing down the rate of advance of the plate elements, in order to continue the processing steps for the non-ejected plate elements normally.

Another aim of the present invention is to make it possible to perform the switching toward either the first downstream module or the second downstream module, or on demand, or according to a programmed frequency. The change of destination of the switching can occur for example after a single plate element is directed to the first downstream module or to the second downstream module, and before a successive series of plate elements is directed to the other downstream module, out of the first downstream module and the second downstream module. That can also occur after a first series of plate elements is directed to the first downstream module or to the second downstream module, and before another successive series of plate elements is directed to the other downstream module out of the first downstream module and the second downstream module.

To this end, the destination of the switching device is rapidly modified, and is done so accurately, in order not to hamper the correct operation of the plate element processing machine.

According to the invention, a switching device for transferring and ejecting a plate element in a sorting unit comprises:

- transport means, the transport means are capable of transporting the plate element from upstream to downstream;
- a pivot, the pivot is positioned in an upstream portion of the transport means, and the pivot allows the transport means to tilt relative to a horizontal transverse axis passing through the pivot; and
- raising means, the raising means are secured in a downstream portion of the transport means, to tilt the downstream portion of the transport means between a high first position and a low second position, and, vice versa, between a low second position and a high first position, so as to switch the plate element respectively upward and downward.

This solution makes it possible, by a simple pivot movement of the tilting part forming the transport means, to direct the plate element in motion either to the first downstream module (first position of the transport means) or to the second downstream module (second position of the transport means). The low second position is situated under the high first position, and likewise the high first position is situated above the low second position.

According to a variant, the transport means have a top face, which is substantially horizontal in the high first position, with this same top face of the transport means being inclined downward in the downstream direction in the low second position of the downstream portion of the transport means. According to another variant, the transport means have a top face, which is substantially horizontal in the low second position, with this same top face of the transport means being inclined upward in the downstream direction in the high first position of the downstream portion of the transport means.

This solution offers the particular advantage in relation to the prior art of not having to stop, nor even slow down the plate element processing machine to effect a rejection of one or more plate elements. Thus, the rate of processing of the plate elements is unchanged. The number of successive plate elements switched to the first downstream module and the number of successive plate elements switched to the second downstream module can be allocated as desired.

The present invention further relates to a sorting unit, comprising

- a switching device as described and claimed, a
- a first downstream module, an input of the first downstream module being situated in the extension of the downstream end of the transport means, when the transport means are in the high first position, and a second downstream module, an input of the second downstream module being situated in the extension of the downstream end of the transport means, when the transport means are in the low second position.

Such a sorting unit makes it possible to perform, in the same machine, different processing operations on the plate elements, depending on whether the plate element passes into the branch provided with the first downstream module or into the branch provided with the second downstream module.

The present invention relates also to a plate element processing machine equipped with a sorting unit, as described and claimed.

The present invention relates also to a method for switching a plate element at the output of a processing machine. The method comprises the steps of:

moving a plate element using transport means;

lowering a downstream portion of the transport means, in order to modify the position of the downstream end of the transport means, by tilting the transport means relative to a horizontal transverse axis;

raising a downstream portion of the transport means, in order to modify the position of the downstream end of the transport means, by tilting the transport means relative to the horizontal transverse axis.

Such a method can be implemented while the plate elements arrive continuously one behind the other on the upstream portion of the transport means.

BRIEF DESCRIPTION OF THE DRAWINGS

Examples of implementation of the invention are indicated in the description illustrated by the attached figures in which.

The longitudinal direction is defined in relation to the direction of transport of the plate elements. The transverse direction is defined as being the direction orthogonal to the transverse direction and in the transport plane of the plate elements. The upstream, and respectively the downstream, is defined as being a backward position, respectively a forward position, in relation to the direction of transport of the plate element.

DETAILED DESCRIPTION OF PREFERRED EMBODIMENTS

Figure 1:
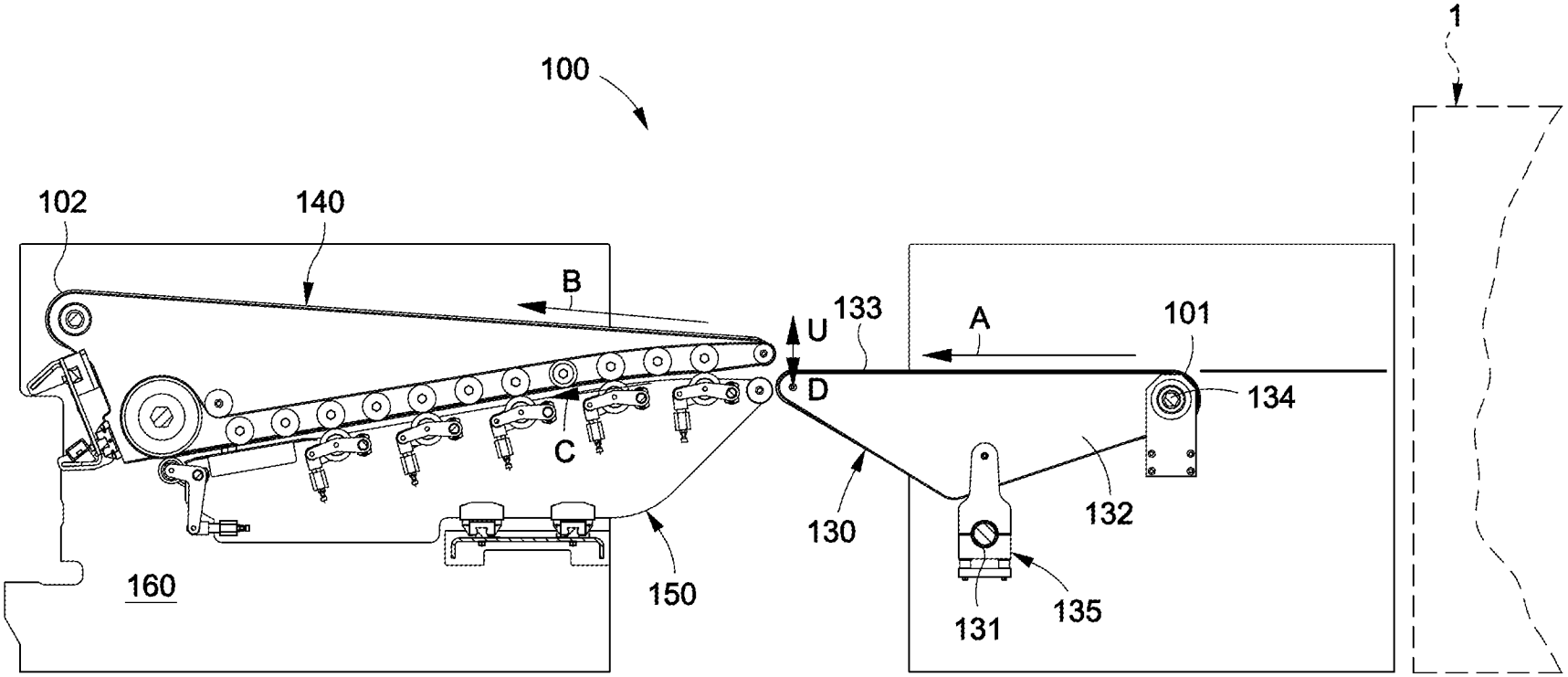
FIG. 1 shows a sorting unit comprising a switching device according to the invention.

The sorting unit 100 illustrated in FIG. 1 forms an assembly arranged at the output of a plate element processing machine 1. One such sorting unit 100 is advantageously arranged downstream of a machine for printing plate elements, such as cardboard sheets. The plate element 20 advances in the processing machine 1 and in the sorting unit 100 from upstream from downstream, according to the line and the direction of the arrow A, i.e. from right to left in the figures.

The sorting unit 100 comprises, from upstream to downstream, an input 101, a switching device 130, a first downstream module 140, a second downstream module 150 and an output 102. The plate element 20 which is printed on its top face arrives on the switching device 130.

Figure 2:
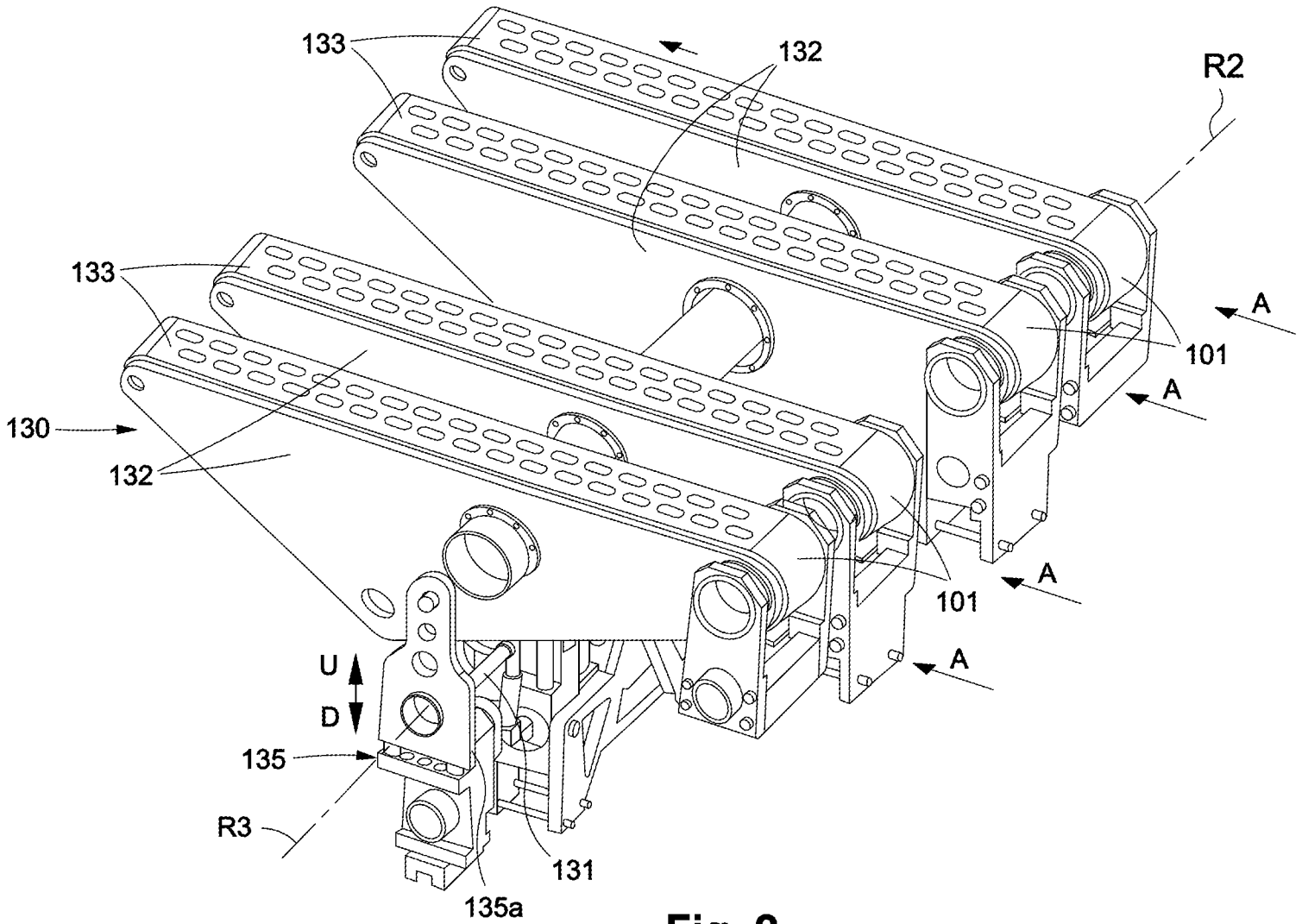
FIG. 2 represents, in perspective, the switching device of FIG. 1.

The switching device 130 comprises transport means 132 forming a part tilting about a shaft 134 of pivot-forming axis R2 (see FIGS. 1 and 2). The transport means 132 comprise a structure, pulleys and at least one transfer belt 133, such as an endless belt. As an example, the transport means 132 comprise four transfer belts 133 which are placed in parallel to one another, in the upstream-downstream direction (FIG. 2).

According to a preferential arrangement the belt or belts 133 are vacuum belts forming a vacuum band conveyor. Openings or perforations are formed in the belts 133 for air suction purposes. The belt or belts 133 are associated with one or more vacuum boxes, which are connected to a vacuum source and which are arranged under the belt or belts 133. The use of vacuum box and belt 133 makes it possible to hold the plate elements 20 during their transport, the plate elements 20 being pressed against the belt or belts 133 without it being necessary to hold the plate elements 20 by their top face. With at least one box and at least one vacuum belt 133, the switching device 130 does not touch the printed top face of the plate elements 20. The printed top face of the plate elements 20 is still fragile, the printing inks are not yet fully dried.

The axis R2, which is oriented in the transverse and horizontal direction, is situated in an upstream or backward portion of the transport means 132. To allow this tilting movement, raising means 135 are mechanically connected to the transport means 132, away from the axis R2. All the transport means 132 are linked to the raising means 135, such that the transfer belts 133 remain parallel to one another.

This parallelism exists in all the positions of the switching device 130, in the high first position, the low second position or an intermediate position of the transport means 132. In all these positions, the top face and the top portion of all the transfer belts 133 remains in the same plane, extending between the upstream and the downstream. This top face of the top portion of the transfer belts 133 forms the reception face for the plate element 20.

Figure 3:
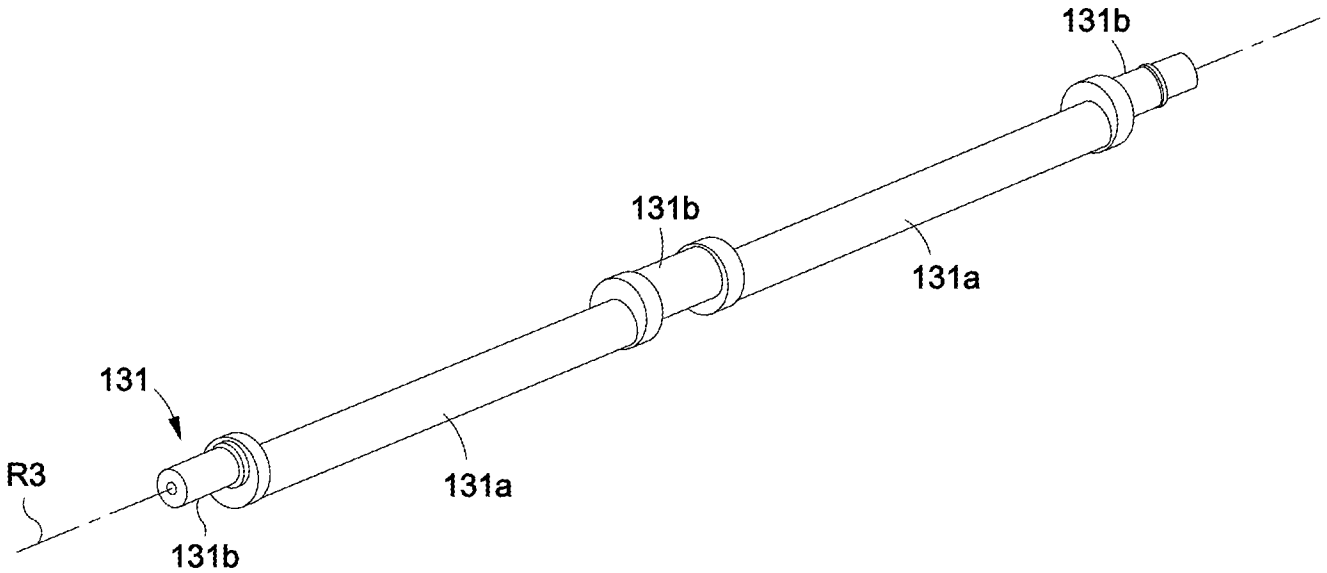
FIG. 3 is a perspective view of an eccentric shaft used in the switching device of FIG. 2.

The raising means 135 comprise an eccentric mechanism with a rotary eccentric shaft, of camshaft type 131 represented in FIG. 3, which is intended to be placed in rotation relative to the axis R3 which can be seen in FIG. 2. More specifically, the rotary eccentric shaft 131 has several eccentric sections 131*a*. At least one of the transport means 132 is secured to an eccentric section 131*a*, by an intermediate part 135*a*, of runner type, fixed to the structure of each of the transport means 132. In fact, in this case, four transport means 132 are present and each pair of transport means is arranged on one and the same eccentric section 131*a*. A central section and two non-eccentric end lateral sections 131*b* make it possible to hold the shaft 131 on bearings.

The switching device 130 is in the high position or first position, and makes it possible to transfer a plate element 20 passing over the switching device 130 to the first downstream module 140. The switching device 130 is in the low position or second position, and makes it possible to transfer a plate element 20 passing over the switching device 130 to the second downstream module 150.

When the operator wishes (manually or by programming of the switching device 130) to modify the destination of the switching device 130, in order to divert one or more plate elements as rejects, the transport means 132 lower (arrow D in FIGS. 1 and 2). When the operator wishes (manually or by programming of the switching device 130) to modify the destination of the switching device 130, in order to divert one or more plate elements for production, the transport means 132 rise (arrow U in FIGS. 1 and 2). A motor drives the rotation by a half-turn (in one direction or in the other), of the shaft 131 provided on the axis R3.

Figure 5:
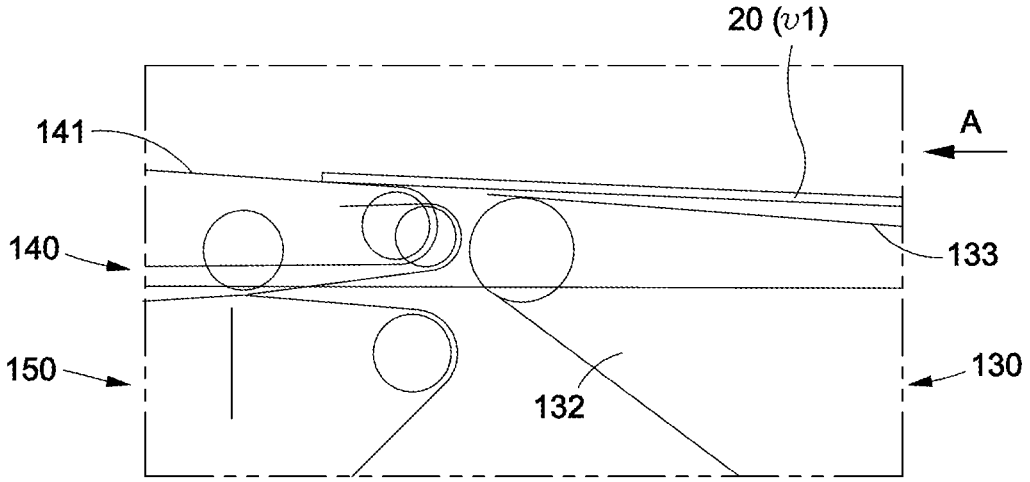
FIGS. 5 to 10 show different steps in the operation of the switching device according to the invention.
Figure 6:
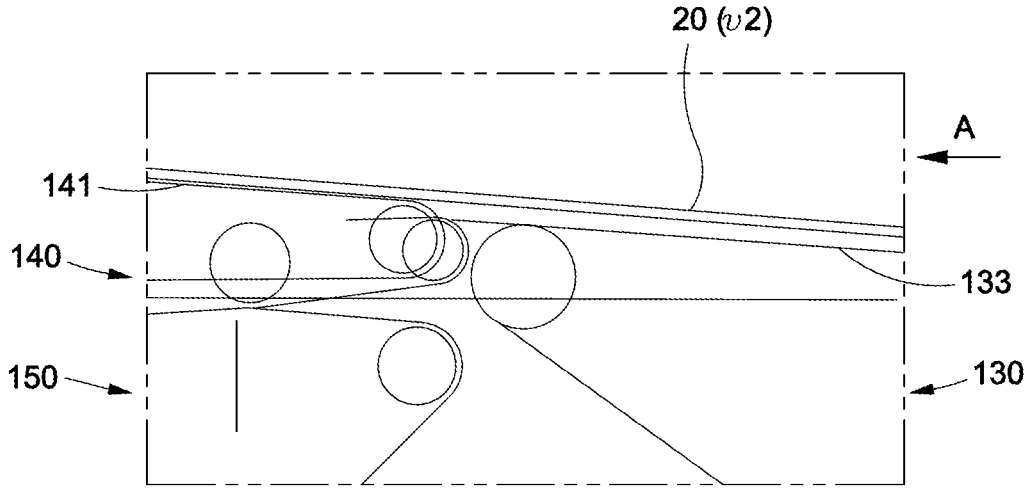
Figure 10:
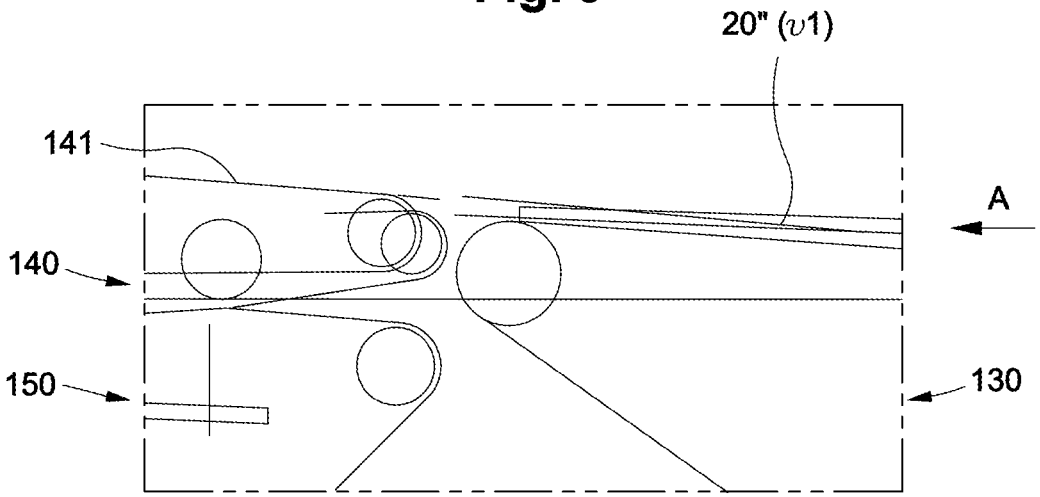

As an example, between the high first position (FIGS. 5 and 10) and the low second position (FIG. 8) of the transport means 132, there is a tilt of the order of 5° of the top portion of the transfer belts 133.

Figure 4:
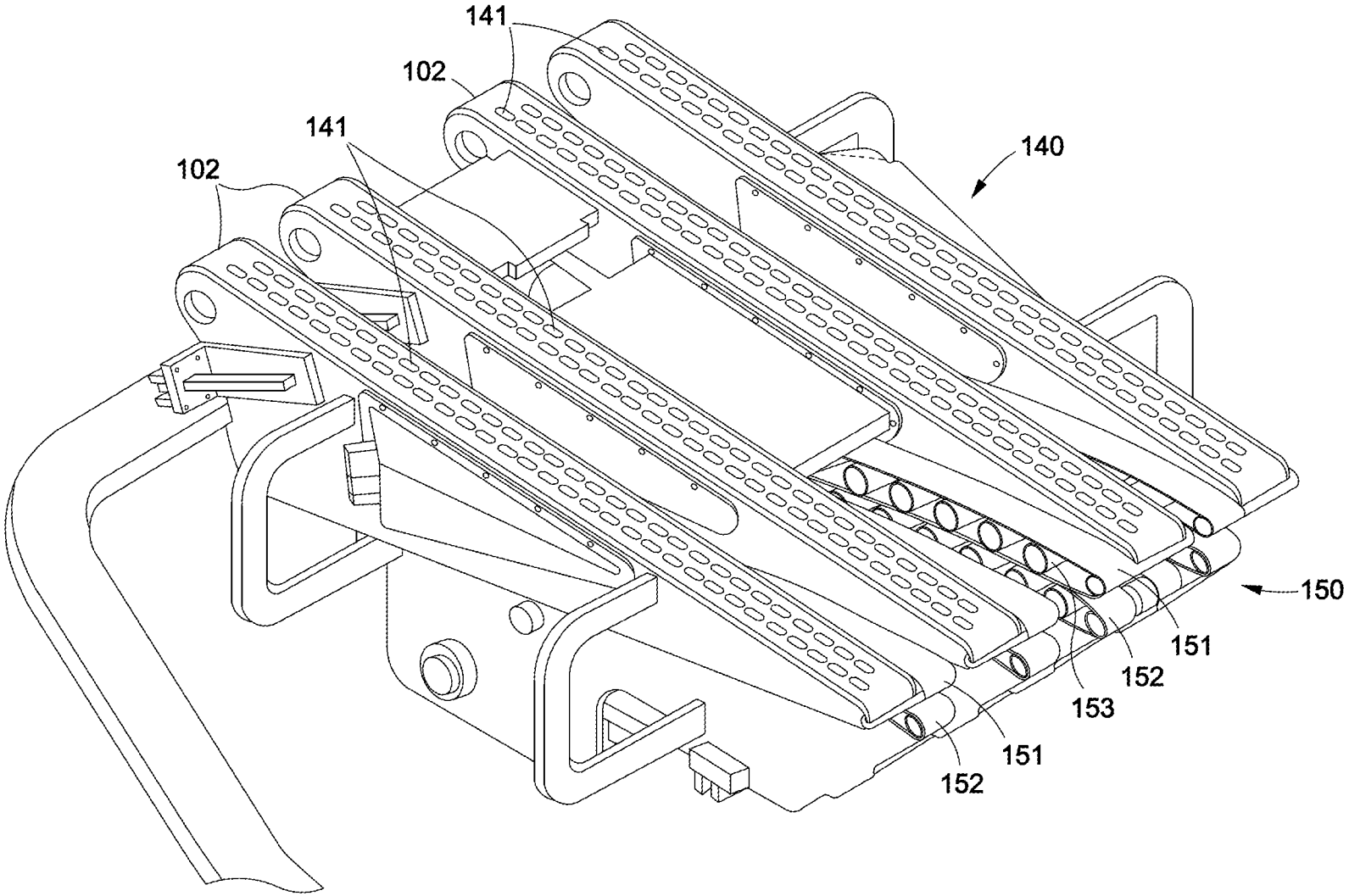
FIG. 4 is a perspective view of the first downstream module and of the second downstream module of the sorting unit of FIG. 1.

The first downstream module 140 is arranged above the second downstream module 150, the two being mounted on the same frame (FIGS. 1 and 4). The first downstream module 140 is capable of conducting a plate element 20 only from its bottom face. Thus since the first downstream module 140 does not enter into contact with the top face of the plate elements 20, the quality of the printing which has previously been applied to the top face of the plate elements 20 is preserved.

More specifically, the first downstream module 140 is capable of moving the plate element 20, arranged flat on one or more first downstream transfer belts 141. The first downstream transfer belts 141 are endless belts, particularly of vacuum type, formed with openings or perforations for air suction purposes. The first downstream transfer belt or belts 141 are associated with one or more vacuum boxes, which are connected to a vacuum source and which are arranged under the first downstream transfer belt or belts 141.

The use of box and first downstream transfer belt 141 makes it possible to hold the plate elements 20 during their transport, the plate elements 20 being pressed against the belt or belts 141 without it being necessary to hold the plate elements 20 by their top face. With at least one box and at least one vacuum belt 141, the printed top face of the plate elements 20 will not be touched by the first downstream module 140. The printed top face of the plate elements 20 is still fragile, the printing inks are not yet fully dried.

Figure 7:
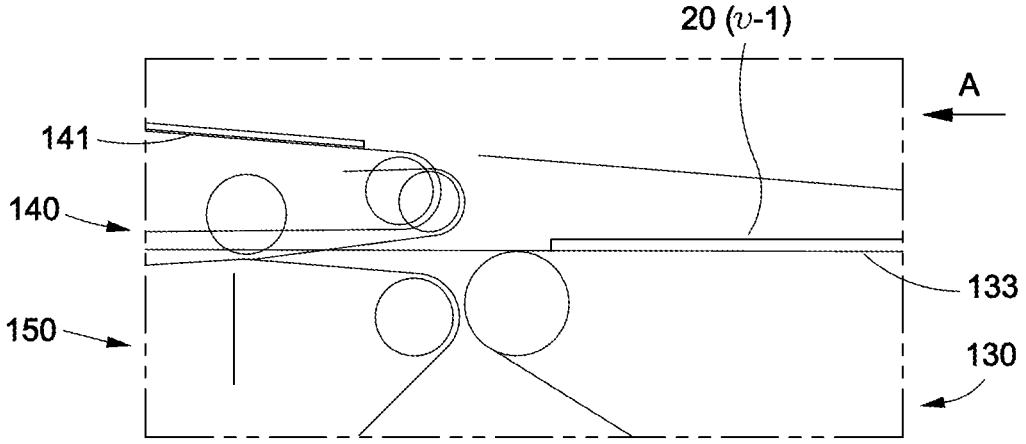

The first downstream transfer belts 141 transport the plate element 20 from upstream to downstream according to a second travel speed v2 higher than the first travel speed v1 used for the switching device 130. In this way, when the plate element 20 arrives from the switching device 130 placed in its first position (FIG. 5), this plate element 20 accelerates between the speed v1 and the speed v2, this increase in its rate of advance making it possible to increase the distance with the next plate element 20' (FIG. 7), to allow the transport means 132 time to tilt downward D and arrive at the height of the input of the second downstream module 150 before the front portion of the next plate element 20' extends over the switching device 130.

As an example, the plate elements advance with a speed v1, an interval of a few millimeters is left between two plate elements 20 on the switching device 130. With an overspeed v2, a few milliseconds make it possible to tilt the transport means 132 between the first position and the second position or, vice versa, between the second position and the first position. Given the speeds and rates of movement for the transport means 132, the switching device 130 according to the invention forms an ejector of flipper type.

Then, the second downstream module 150 can have different configurations and use. In particular, the second downstream module 150 is capable of conducting a plate element 20 from its bottom face and/or from its top face to a reception station for rejects 160 (see FIG. 1).

Figure 8:
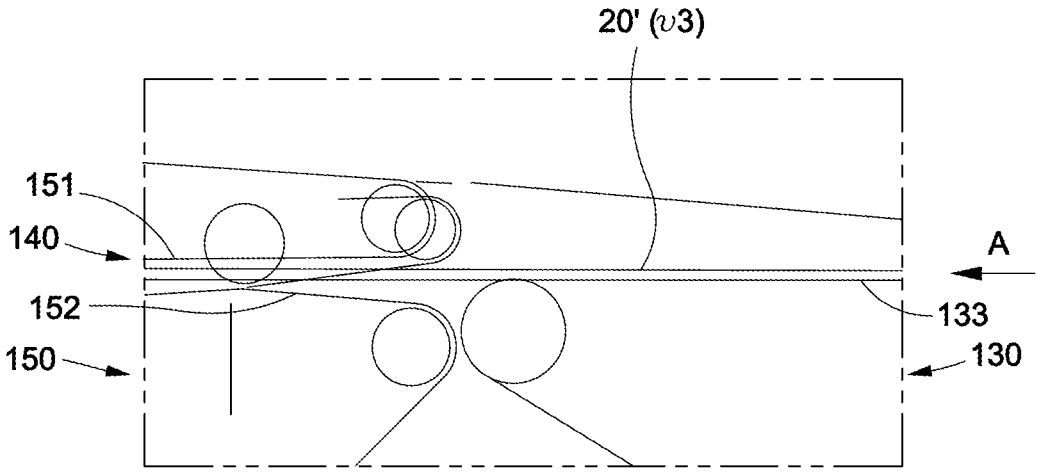
Figure 9:
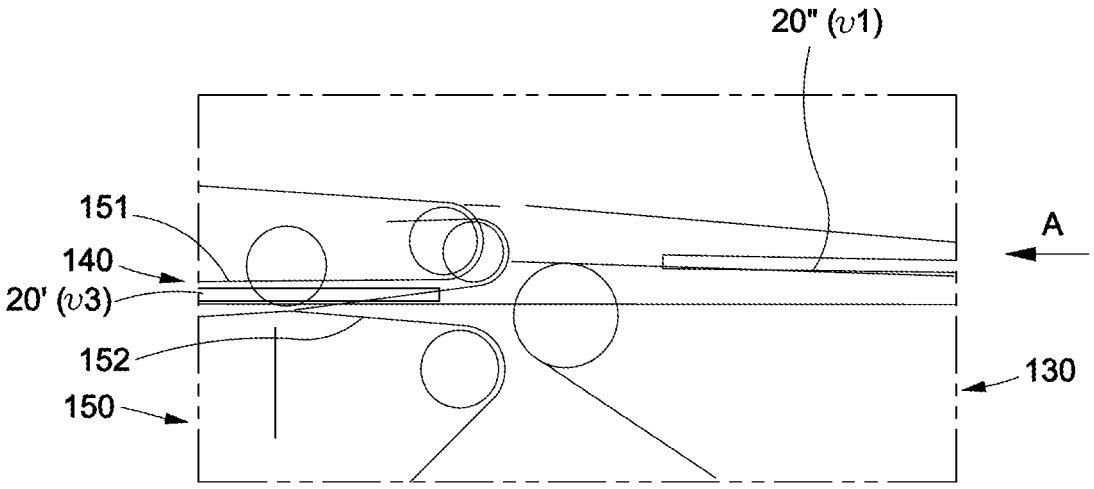

According to one embodiment, the second downstream module 150 is capable of moving the plate element 20, from upstream to downstream, according to a third travel speed v3 higher than the first travel speed v1 (see FIG. 8). This third travel speed v3 constitutes an overspeed making it possible to more rapidly disengage the plate element 20' from the switching device 130 in the second downstream module 150. This third travel speed v3 can be equal to the second travel speed v2. Thus, time is allowed for the transport means 132 to tilt upward, from the second position to the first position, and arrive at the height of the input of the first downstream module 140 before the front portion of the next plate element 20" extends over the switching device 130 (see FIGS. 9 and 10).

According to one embodiment, the second downstream module 150 allows for the advance of the plate element 20 arranged flat on a transfer belt. In the exemplary embodiment illustrated, the circuit of a plate element 20 going to scrap passes through the switching means 130 with the transport means 132 in the low second position, and the second downstream module 150. Moreover, according to the embodiment illustrated, the second downstream module 150 comprises, to drive the plate element 20, pairs of second downstream endless belts 151 and 152 arranged facing one another, and set in motion around drive rollers 153.

The pairs of second downstream endless belts 151 and 152 are offset in relation to the first downstream transfer belts 141, and inserted between the first downstream transfer belts 141. This arrangement means that the first downstream module 140 and the second downstream module 150 are nested one inside the other, which makes the first downstream module 140 and second downstream module 150 arrangement particularly compact in just one and the same frame.

At this stage, the plate element 20 entering into the second downstream module 150 is considered to be waste. The pairs of second downstream endless belts 151 and 152 will be able to catch, clamp and transport the plate element 20 between them, to the rejection reception station 160, even if the printed top face of the plate elements 20 is still fragile, and the printing inks are not yet fully dried.

The invention relates also to a method for switching the path of a plate element in a sorting unit 100 at the output of a processing machine 1, comprising the following steps:

- movement between upstream and downstream A, according to a first travel speed v1, of a plate element 20 arranged flat on a mobile transfer belt 133 of the transport means 132 having a pivot 134 allowing the U and D tilting of the transport means 132 about a horizontal axis R2, in order to modify the position of the downstream portion of the transport means 132 between a high first position U and a low second position D,
- lowering D of the downstream portion of the transport means 132 from the first position after the passage of at least half the length of a plate element 20, then
- raising U of the downstream portion of the transport means 132 from the second position after the passage of the rear end of a plate element 20 over the downstream portion of the transport means 132, such that the downstream portion of the transport means 132 ends its rise to the first position at the latest upon the arrival of the front end of the next plate element 20' on the upstream end 101 of the transfer belt 133.

In this method, depending on the destination of the plate element and on the starting position, low or high, of the transport means, the lowering step can precede or follow the rising step.

Consequently, the present invention also covers a method for switching the path of a plate element 20 in a sorting unit at the output of a processing machine 1, comprising the following steps:

movement between upstream and downstream A, according to a first travel speed v1, of a plate element 20 arranged flat on a mobile transfer belt 133 of the transport means 132 having a pivot 134 making it possible to tilt the transport means 132 about a horizontal axis R2, in order to modify the position of the downstream portion of the transport means 132 between a high first position U and a low second position D, raising U of the downstream portion of the transport means 132, from the second position after the passage of the rear end of a plate element 20 over the downstream portion of the transport means 132, such that the downstream portion of the transport means 132 ends its rise to the first position at the latest upon the arrival of the front end of the next plate element 20' on the upstream end 101 of the transfer belt 133, then lowering D of the downstream portion of the transport means 132, from the first position after the passage of at least half of the length of a plate element 20.

The present invention is not limited to the embodiments described and illustrated. Numerous modifications can be made, without in any way departing from the framework defined by the scope of the set of claims.

The invention claimed is:

1. A switching device for transferring and ejecting a plate element in a sorting unit, the switching device comprising:

a transport conveyor to operate at a first travel speed upon both receipt of the plate element at an upstream entry of the transport conveyor and conveyance of the plate element from the transport conveyor at a downstream exit of the transport conveyor;

a pivot, positioned in an upstream portion of the transport conveyor, and allowing the transport conveyor to tilt relative to a horizontal transverse axis of the transport conveyor; and a raising means comprising an eccentric mechanism, secured in a downstream portion of the transport conveyor, to tilt the downstream portion of the transport conveyor between a high first position and a low second position, and vice versa, so as to switch the plate element, respectively upward and downward independently from a conveying movement of the transport conveyor, wherein the eccentric mechanism further comprises a rotary eccentric shaft having an eccentric section having a first rotary shaft and a non-eccentric section having a second rotary shaft offset from the first rotary shaft in a radial direction relative to an axis of rotation of the rotary eccentric shaft.

2. The switching device of claim 1, in which the transport conveyor comprises at least one transfer belt.

3. The switching device of claim 1, in which the transport conveyor comprises at least one vacuum transfer belt associated with a vacuum box.

4. A method for switching a plate element at an output of the sorting unit of claim 1, the method comprising:

moving the plate element using the transport conveyor operating at the first travel speed upon both receipt of the plate element at the upstream entry of the transport conveyor and conveyance of the plate element from the transport conveyor at the downstream exit of the transport conveyor;

lowering the downstream portion of the transport conveyor independently from the conveying movement of the transport conveyor, in order to modify a position of the downstream portion of the transport conveyor, by tilting the transport conveyor relative to the horizontal transverse axis of the transport conveyor; and raising the downstream portion of the transport conveyor independently from the conveying movement of the transport conveyor, in order to modify the position of the downstream portion of the transport conveyor, by tilting the transport conveyor relative to the horizontal transverse axis of the transport conveyor.

5. A sorting unit comprising:

a switching device for transferring and ejecting a plate element in the sorting unit, the switching device comprising:

a transport conveyor to operate at a first travel speed upon both receipt of the plate element at an upstream entry of the transport conveyor and conveyance of the plate element from the transport conveyor at a downstream exit of the transport conveyor;

a pivot, positioned in an upstream portion of the transport conveyor, and allowing the transport conveyor to tilt relative to a horizontal transverse axis of the transport conveyor; and a raising means, secured in a downstream portion of the transport conveyor, to tilt the downstream portion of the transport conveyor between a high first position and a low second position, and vice versa, so as to switch the plate element, respectively upward and downward independently from a conveying movement of the transport conveyor, a first downstream module, an input of the first downstream module being situated downstream of the downstream exit of the transport conveyor, when the transport conveyor is in the high first position, and a second downstream module, an input of the second downstream module being situated downstream of the downstream exit of the transport conveyor, when the transport conveyor is in the low second position, wherein a conveyor of the first downstream module is offset in a direction, parallel to the horizontal transverse axis of the transport conveyor, from a conveyor of the second downstream module, and the second downstream module is nested inside the first downstream module.

6. The sorting unit of claim 5, in which the first downstream module is capable of holding and transporting the plate element by a bottom face of the plate element.

7. The sorting unit of claim 5, in which the transport conveyor of the switching device is capable of transporting the plate element according to the first travel speed, and the first downstream module is capable of transporting the plate element according to a second travel speed higher than the first travel speed as the plate element is transported from the transport conveyor to the first downstream module to increase a spacing distance between the plate element and a successive plate element positioned upstream of the plate element on the transport conveyor.

8. The sorting unit of claim 5, in which the second downstream module is capable of holding and transporting the plate element by at least one of a bottom face or a top face to a reject reception station.

9. The sorting unit of claim 5, in which the transport conveyor of the switching device is capable of transporting the plate element according to a first travel speed, and the second downstream module is capable of moving the plate element according to a second travel speed higher than the first travel speed as the plate element is transported from the transport conveyor to the second downstream module to increase a spacing distance between the plate element and a successive plate element positioned upstream of the plate element on the transport conveyor.

10. A plate element processing machine equipped with the sorting unit as claimed in claim 5.

* * * * *